US005199285A

United States Patent [19]

Lin

[11] Patent Number: 5,199,285

[45] Date of Patent: Apr. 6, 1993

[54] LOCKING DEVICE FOR AN AUXILIARY LOCK

[75] Inventor: Jui C. Lin, Kaohsiung Hsien, Taiwan

[73] Assignee: Taiwan Fu Hsing Industry Co., Ltd., Kangshan Kaohsiung Hsien, Taiwan

[21] Appl. No.: 778,238

[22] Filed: Oct. 17, 1991

[51] Int. Cl.[5] ..... E05B 13/10

[52] U.S. Cl. ..... 70/220; 70/190; 70/224; 70/379 R; 70/381

[58] Field of Search ..... 70/220–224, 70/214–217, 190, 191, 284, 285, 379 R, 379 A, 380, 448, 449, 452

[56] References Cited

U.S. PATENT DOCUMENTS

| | | | |
|---|---|---|---|
| 847,348 | 3/1907 | Lyons | 70/220 |
| 1,220,996 | 3/1917 | Shepherd | 70/191 X |
| 1,297,038 | 3/1919 | Timmerhoff | 70/191 X |
| 1,581,409 | 4/1926 | Walker | 70/191 |
| 1,899,997 | 3/1933 | Sullivan | 70/222 |
| 2,135,323 | 11/1938 | Brantingson | 70/379 R |
| 2,742,314 | 4/1956 | Santos | 70/223 |
| 2,862,381 | 12/1958 | Fresard | 70/379 R X |
| 3,718,015 | 2/1973 | Tornoe et al. | 70/224 |
| 3,922,896 | 12/1975 | Kagoura | 70/223 |
| 4,428,570 | 1/1984 | Foshee et al. | 70/224 X |
| 5,010,749 | 4/1991 | Lin | 70/190 |

FOREIGN PATENT DOCUMENTS

| | | | |
|---|---|---|---|
| 112206 | 2/1929 | Austria | 70/223 |
| 590153 | 12/1933 | Fed. Rep. of Germany | 70/190 |
| 603590 | 10/1934 | Fed. Rep. of Germany | 70/223 |
| 670861 | 7/1989 | Switzerland | 70/223 |

*Primary Examiner*—Renee S. Luebke
*Assistant Examiner*—Suzanne L. Dino
*Attorney, Agent, or Firm*—Jacobson, Price, Holman & Stern

[57] ABSTRACT

A locking device for an auxiliary lock comprising a safety button able to be pressed in and a rotating ring to be rotated to actuate the dead lock to be extended for locking the lock.

4 Claims, 5 Drawing Sheets

LOCKING DEVICE FOR AN AUXILIARY LOCK

BACKGROUND OF THE INVENTION

There is a locking device for an auxiliary lock of U.S. Pat. No. 5,010,749, which comprises a rotatable ring and a base. The ring is fitted around the auxiliary lock and combined with the base. Then they are mounted in the door to let a large part of the rotating ring be exposed outside the door, and rotating the ring can cause the dead bolt of the auxiliary lock to extend out, locking the door.

However, a safety means is not accommodated in this device, so the rotating ring may be turned by mistake, locking the door without any intention to do that.

SUMMARY OF THE INVENTION

This invention has aimed to improve the locking device for an auxiliary lock, by additionally providing it with a safety button which is to be pressed in before turning the rotating ring of locking a door, preventing the door from being locked by mistake without such an intention.

DETAILED DESCRIPTION OF THE INVENTION

Figure 1:
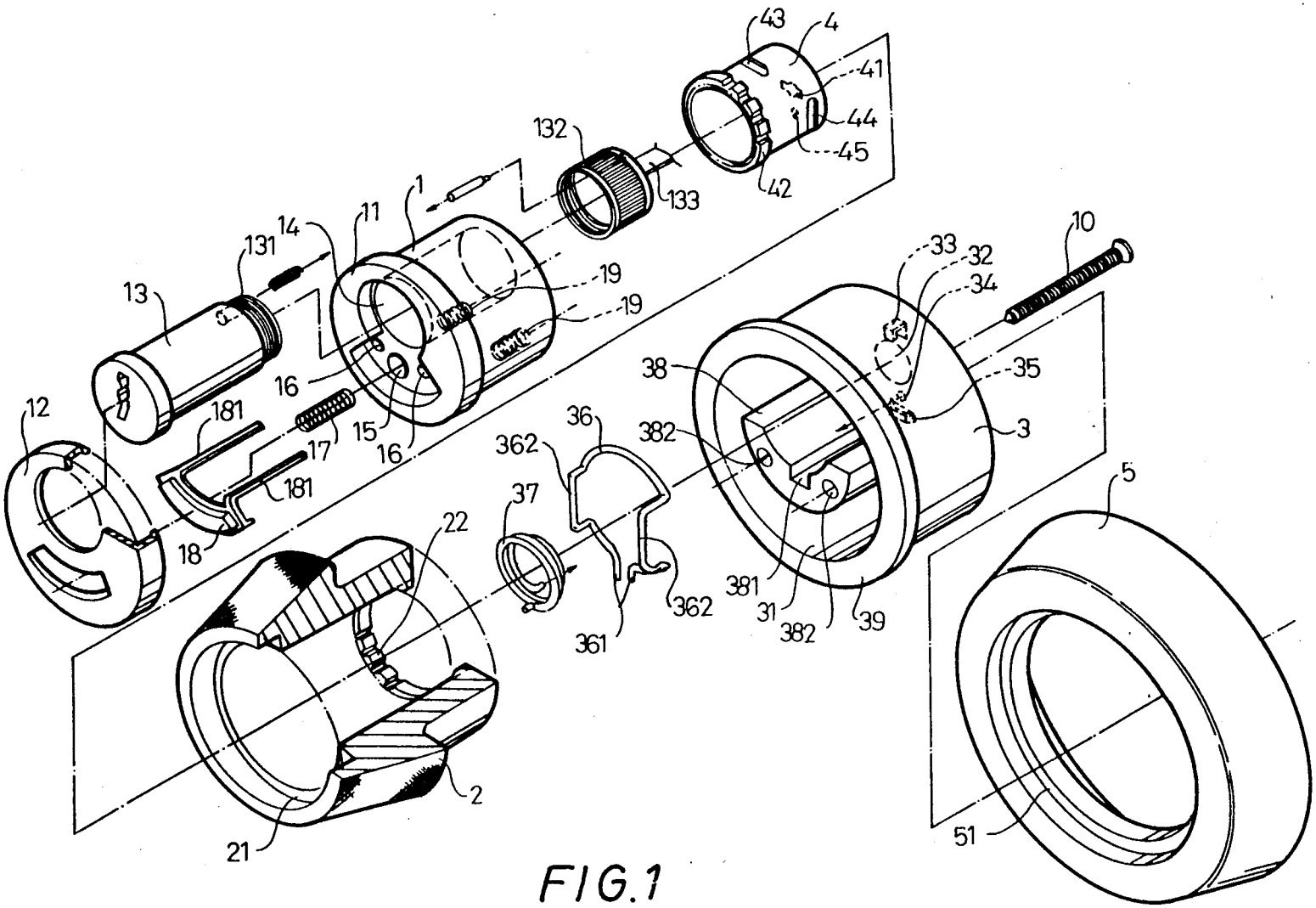
FIG. 1 is an exploded perspective view of the locking device for an auxiliary lock in the present invention.

The locking device for an auxiliary lock in the present invention, as shown in FIG. 1, comprises a lock 1, a rotatable ring 2, a base 3, an actuating wheel 4 and an ornament ring 5 as its main components.

The lock 1 has a projecting periperal edge 11 for a cap 12 to engage with, an interior round cavity 14 for a key block 13 to fit therein, a hole 15 for a coiled spring 17 to fit therein, two long holes 16 for two feet 181 of a safety button 18 to fit through to push the actuating wheel 4, and two threaded holes 19 in the bottom for bolts 10 to combine the lock 1 with the base 3. The key block 13 has a threaded portion 131 at one end to screw with a nut 132 having an actuating plate 133 passing through an actuating hole 41 in the actuating wheel 4. The coiled spring 17 has one of its ends resting on the inner surface of the safety button 18 so as to make the feet 181 of the said button 18 always extending through out of the holes 16.

The rotating ring 2 has an inner spherical recess for the lock 1 and the cap 12 to fit therein to combine together with the rotating ring 2, able to rotate around the outer surface of the lock 1. The ring 2 also has inner spherical teeth 22 around the inner spherical surface at the bottom to engage with teeth 42 in the actuating wheel 4.

The base 3 is cylindrical, having an opening 31 for the rotating ring 2 to fit and rotate therein, a hole 32 in the bottom for the actuating plate 133 to pass through, a hook 33, a position hole 34 and a position block 35 around the hole 32. The hook 33 is to hook an elastic clamp 36 at its position, the position hole 34 is for one foot of a spring 37 to extend in and the position block 35 is to support said foot in its position so as to enable the spring 37 to extend in lengthwise direction to push the actuating wheel 4.

The base 3 also has a short curved wall 38 in its interior in such a position that the wall of the rotating ring 2 can insert in the cavity between the short wall 38 and the inner spherical surface of the base 3, and the actuating wheel 4 can smoothly rotate around on the curved surface of the short wall 38. The short wall 38 has a lengthwise straight groove 381 in the curved surface for the two ends 361 of the elastic clamp 36 to fit therein so as to let two shoulders 362 of the elastic clamp 36 pinching a first slot 43 or a second slot 44 in the actuating wheel 4, and two parallel lengthwise holes 382 for bolts 10 to extend therein for combining the base 3 together with the lock 1.

The actuating wheel 4 is positioned around the the nut 132, having an actuating rectangular hole 41 for the actuating plate 133 of the nut 132 to pass through, several teeth 42 on the outer spherical edge at the right end to engage with the inner spherical teeth 22 of the rotating ring 2, two slots 43, 44—the first one 43, the second one 44—parallel to each other and spaced apart 90° i.e. on different spherical lines, and a position hole 45 in the bottom for one end of the spring 37 to insert therein for the actuating wheel 4 to be constantly pushed by the spring 37 and thus for the teeth 42 possibly to be separated from the inner spherical teeth 22 of the rotating ring 2 or for said wheel 4 to be pulled back to its original position by the elasticity of the spring 37.

The ornament ring 5 is to be fixed around the base 3 after assembling the base 3 with the lock 1, with a flange 39 of the base 3 engaging an inner spherical recess 51 of the ornament ring 5, giving an outward ornament to the base 3.

Figure 2:
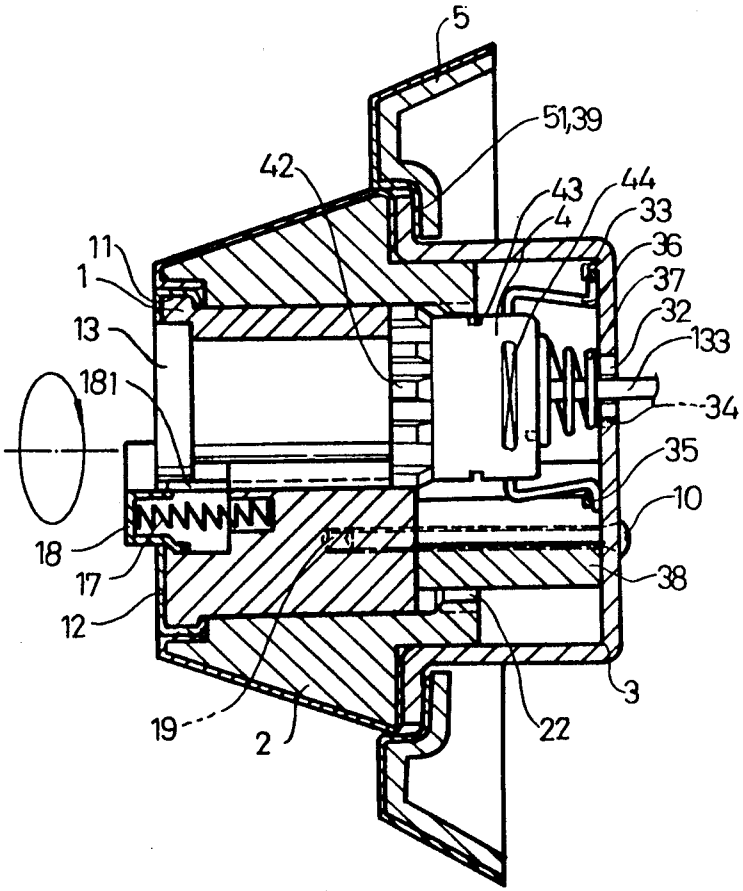
FIG. 2 is a cross-sectional view of the first embodiment of the locking device for an auxiliary lock in the present invention.

FIG. 2 shows that the dead bolt is in the unlocked position and ready to be locked and the actuating plate 133 is in horizontal position, the actuating wheel 4 being pushed by the spring 37, the teeth 42 being disengaged from the teeth 22, and the actuating wheel 4 being in contact with the feet 181 of the safety button 18. Under this position, the rotating ring 2 can only be rotated idle, because of disengagement of the rotating ring 2 from the actuating wheel 4.

Figure 3:
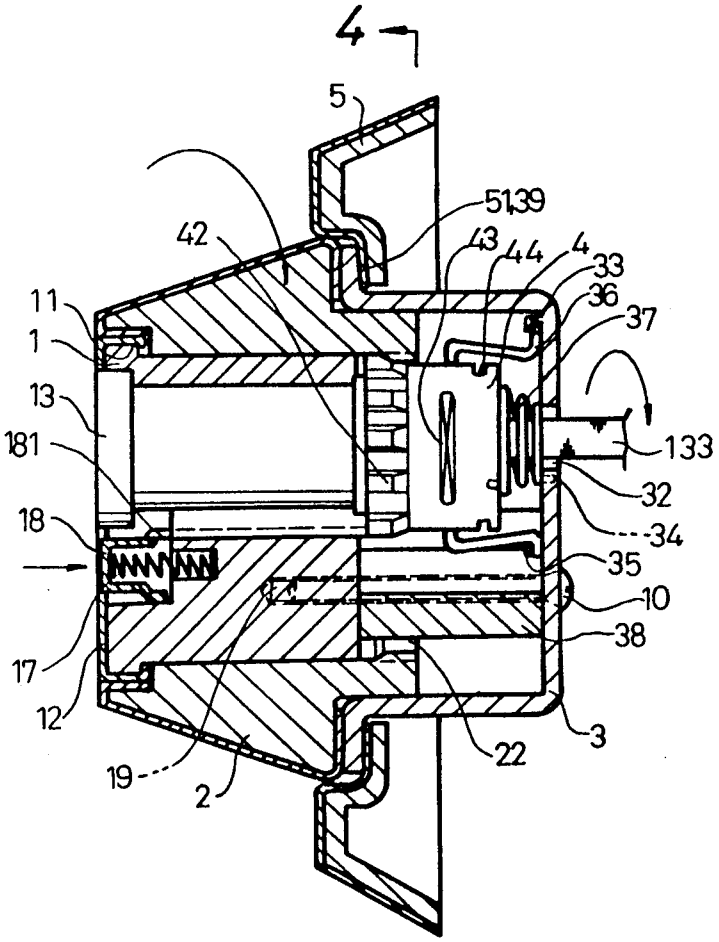
FIG. 3 :s an operational view of FIG. 2.

FIG. 3 shows that for locking the lock the safety button 18 positioned at the outside of a door is to be pressed in, with the feet 181 directly pushing back the actuating wheel 4 so that the first slot 43 may be pinched in by the shoulders 362 of the elastic clamp 36. Then the safety button 18 can be pushed back by the spring 17 to its original position shown in FIG. 2. But the actuating wheel 4 caught by the elastic clamp 36 can have its teeth 42 engaging some of the inner teeth of the rotating ring 2 such that turning the rotating ring 2 rotates the actuating wheel 4 for 90° as the actuating plate 133 passing through the hole 41 can turn only for 90°. Therefore the actuating plate 133 is rotated 90° by the actuating wheel 4 and stopped at that position, owing to the dead bolt combined with the plate 133.

Figure 5:
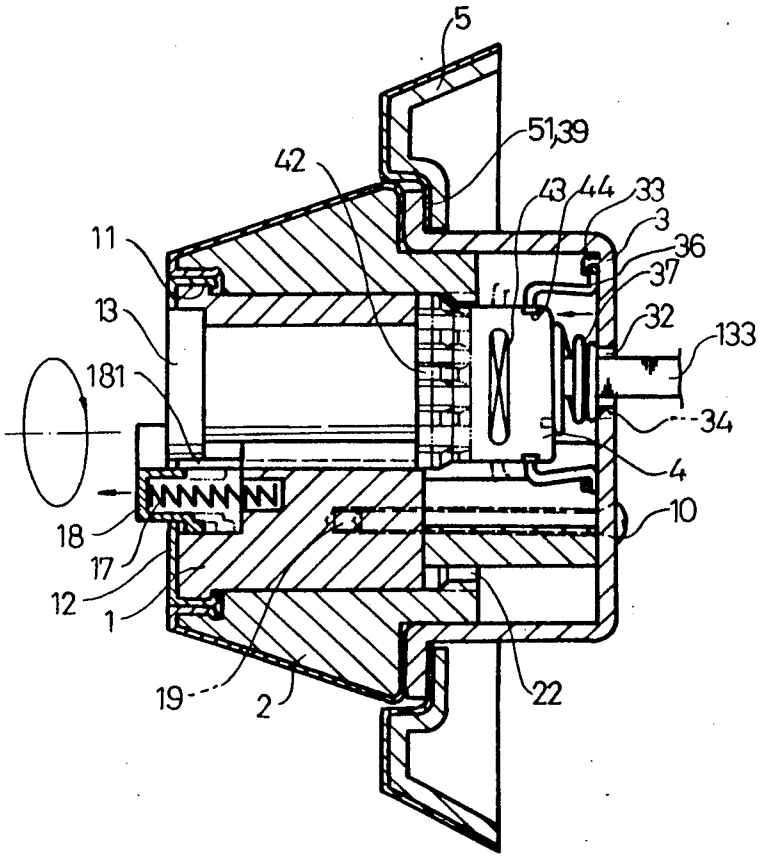
FIG. 5 is an operational view of FIG. 3.
Figure 4:
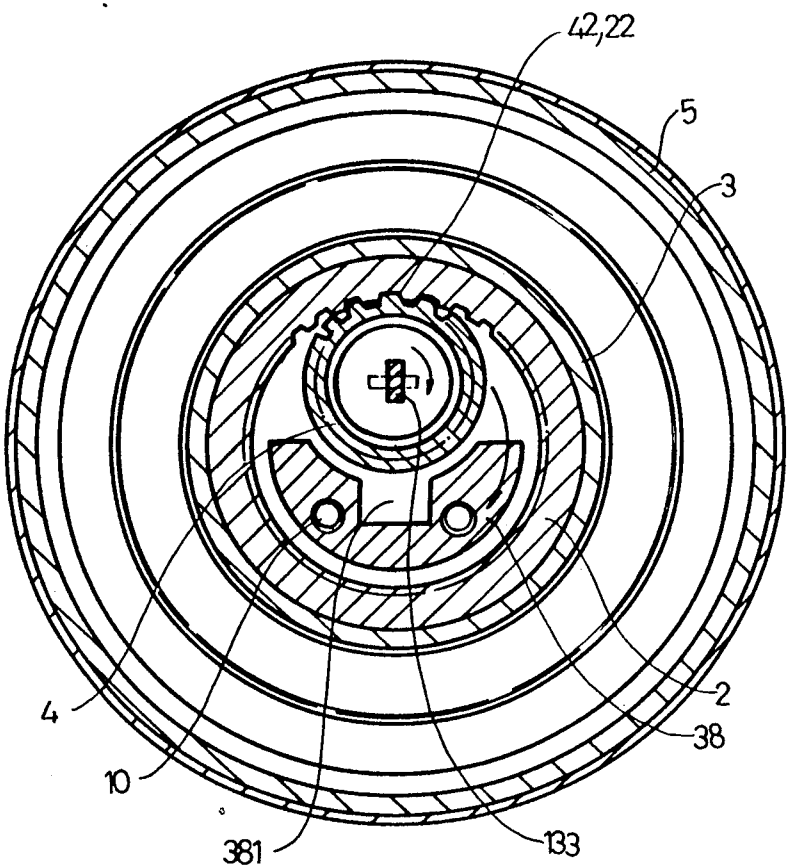
FIG. 4 is an cross-sectional view of line 4—4 in FIG. 3.

FIG. 5 shows that when the force for turning the rotating ring 2 disappears, the actuating wheel 4 is pushed back to its original position by resilience of the spring 37 and the shoulders 362 move to stick in the second slots 44 of the actuating wheel 4. Although the spring 37 has resilience for rotating the wheel 4, the wheel 4 still cannot turn stopped by the actuating plate 133 controlled by the dead bolt and only moves back straight as to cause the teeth 42 to disengage from the inner teeth 22 of the rotating ring 2. Under this condition, the rotating ring 2 can turn only idle.

When this lock is locked as shown in FIG. 5, the safety button 18 can no longer be pressed in, because the actuating wheel 4 also cannot move hampered by the elastic clamp 36 pinching the wheel 4 at the second slot 44. For unlocking this lock, either a correct key is to be used to turn the key block 13 at the outside of the door, or the turning button at the inside is to be turned so as to force the actuating plate 133 to be directly turned to actuate the dead bolt to be retracted. So the actuating wheel 4 is also rotated back by the actuating plate 133 to its original position shown in FIG. 2, in the position ready for locking.

Figure 6:
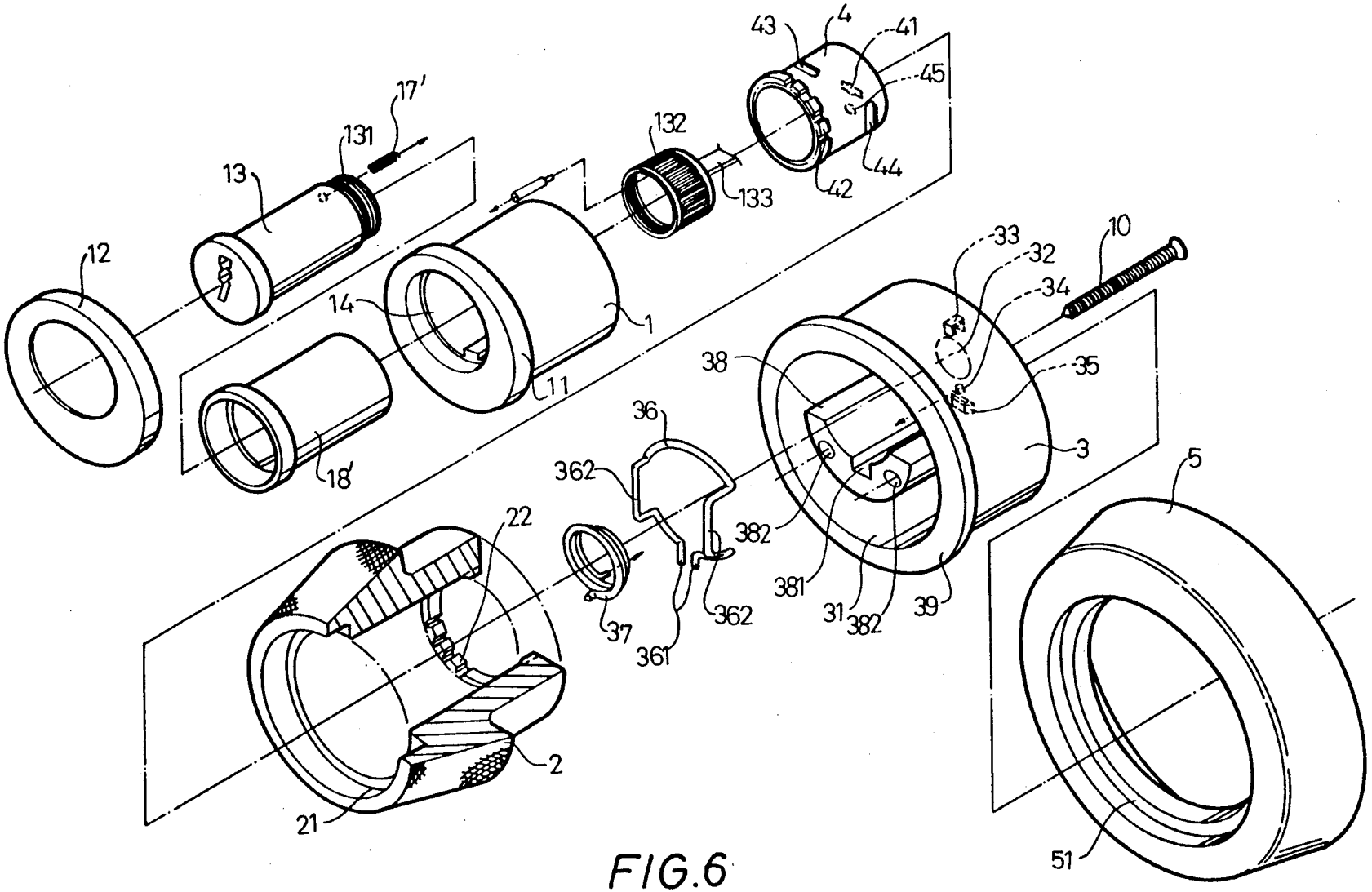
FIG. 6 is the second embodiment of the locking device for an auxiliary lock in the present invention.
Figure 8:
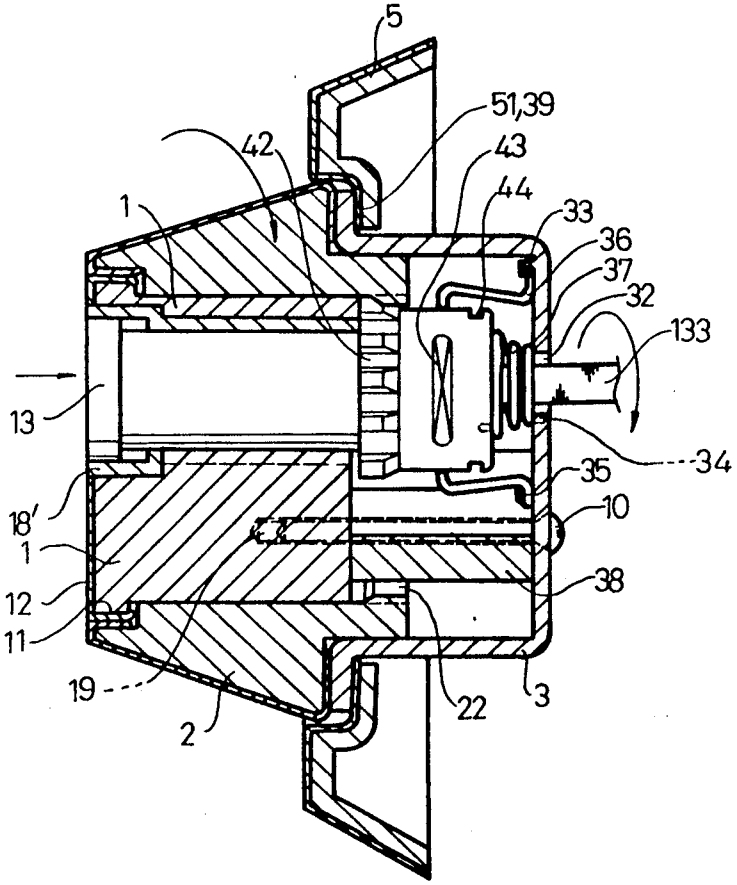
FIG. 8 is an operational view of FIG. 7.
Figure 7:
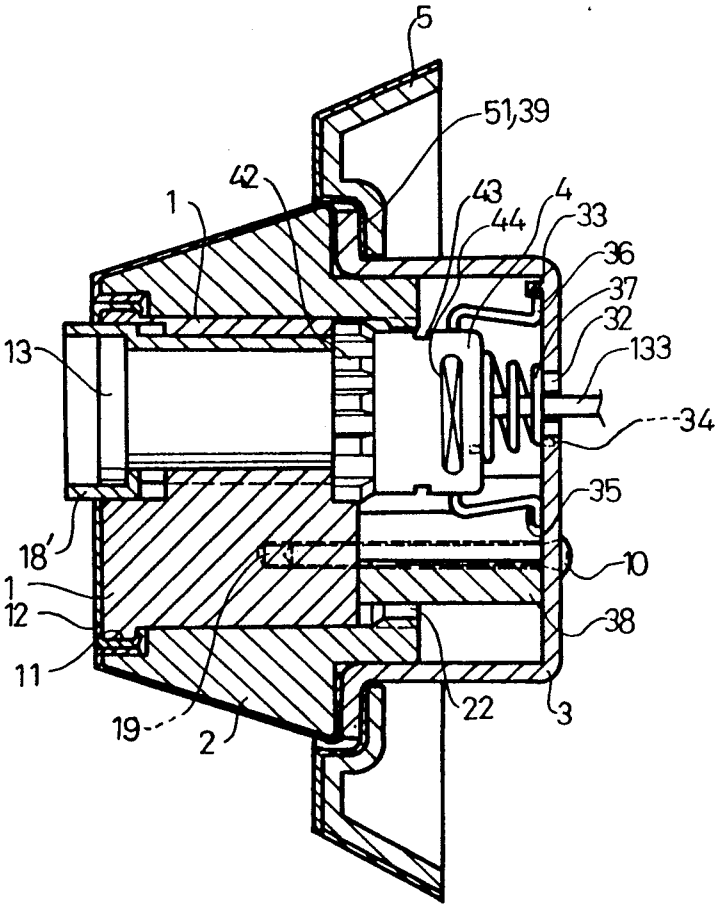
FIG. 7 is a cross-sectional view of the second embodiment of the locking device for an auxiliary lock in the present invention.

The second embodiment of the locking device for an auxiliary lock, as shown in FIGS. 6, 7, 8, comprises the same components, a rotating ring 2, a base 3, an actuating wheel 4 and an ornament ring 5 as the first embodiment do, but a lock 1 and a safety button 18' different from those in the first embodiment. The safety button 18' is shaped cylindrically and has a flange, fitting around the key block 13 and returning to its original position by means of a spring. The safety button 18' can extend out a little from the interior of the lock 1, as shown in FIG. 7, only when the actuating wheel 4 is pushed straight back by the spring 37. The lock 1 does not have a hole 15 or long holes 16 as that in the first embodiment. The locking and unlocking theory of the second embodiment is just the same as the first one, needless to repeat again.

What is claimed is:

1. A locking device for an auxiliary lock comprising;

a lock having a central opening for a key block to fit in, a safety button with two legs, two long holes in the lock for the legs of the safety button to extend through, to contact with an actuating wheel, the actuating wheel having outer peripheral teeth and being combined with a nut having an acutating plate to extend through an actuating hole in the bottom of the actuating wheel, the lock being covered with a cap, the lock fitting in the interior of a rotating ring and being combined with a base by means of two bolts screwed in two threaded holes in a bottom of the base;

the rotating ring fitting around an outer spherical surface of the lock, and fitting and rotating in the base, the rotating ring having inner spherical teeth to engage or disengage from the teeth on the actuating wheel;

the base shaped cylindrically, having an interior round cavity for the rotating ring to fit and rotate therein, the base having a bottom wall with a hole for the actuating plate to pass through, a hook on the wall, a position hole in the wall and a position block adjacent the hole, the hook positioning an elastic clamp which has shoulders to pinch in a first slot or a second slot of the actuating wheel, the position hole and the position block locating one end of a spring, having the other end fitting in a hole in the actuating wheel so that the actuating wheel can be pushed straight or rotatingly back to an original position by means of the spring;

the actuating wheel being urged by the spring to have its teeth disengaged from the inner teeth of the rotating ring, the slots of the actuating wheel being movable for pinching by the elastic clamp by pressing in the safety button so that the teeth of the actuating wheel may engage the inner teeth of the rotating ring, the rotating ring being rotatable through 90° to rotate the actuating wheel, which then rotates the actuating plate 90° to extend a dead bolt for locking the lock.

2. The locking device for an auxiliary lock as claimed in claim 1, wherein the first slot and the second slot provided in the actuating wheel are separated by 9020 , and both the slots can be pinched by the shoulders of the elastic clamp to prevent the actuating wheel from moving in line.

3. The locking device for an auxiliary lock as claimed in claim 1, wherein said the safety button is to be pushed back to its original position by an elastic member after it has been pressed in.

4. The locking device for an auxiliary lock as claimed in claim 1, wherein the slots in the actuating wheel are to separate from the elastic clamp when the actuating wheel is rotated.

* * * * *